US006351975B1

(12) United States Patent
Valdes

(10) Patent No.: US 6,351,975 B1
(45) Date of Patent: Mar. 5, 2002

(54) BOLT LOCK WITH PROTECTIVE COVER

(76) Inventor: Mark Valdes, 1837 7th St., Santa Monica, CA (US) 90401

( * ) Notice: Subject to any disclaimer, the term of this patent is extended or adjusted under 35 U.S.C. 154(b) by 6 days.

(21) Appl. No.: 09/770,413

(22) Filed: Jan. 29, 2001

(51) Int. Cl.[7] ..... E05B 67/38
(52) U.S. Cl. ..... 70/56; 70/129; 292/148
(58) Field of Search ..... 70/53–56, 2, 416, 70/417, 129, 448, 451, 466; 292/148, DIG. 53

(56) References Cited

U.S. PATENT DOCUMENTS 3,778,079 A * 12/1973 Vornberger et al. ..... 292/148 X
4,095,828 A * 6/1978 East ..... 292/148
4,214,783 A * 7/1980 Boegeman ..... 292/148 X
4,229,956 A * 10/1980 Thorburn ..... 70/129
4,234,220 A * 11/1980 Finch et al. ..... 292/148
4,307,904 A * 12/1981 Daus ..... 70/56 X
4,615,548 A * 10/1986 McGee ..... 292/148 X
4,782,675 A * 11/1988 Thorburn ..... 70/129
4,792,167 A * 12/1988 King et al. ..... 292/148 X
4,802,351 A * 2/1989 Kojak ..... 70/56
4,877,275 A * 10/1989 DeForrest, Sr. ..... 70/56 X
4,883,294 A * 11/1989 Goodspeed ..... 70/56 X
4,884,421 A * 12/1989 Lindsay ..... 70/129
4,911,486 A * 3/1990 Anderson ..... 70/54 X
4,932,692 A * 6/1990 Nelson ..... 292/148
4,977,763 A * 12/1990 Sewell ..... 70/54
5,931,032 A * 8/1999 Gregory ..... 70/129

* cited by examiner

*Primary Examiner*—Suzanne Dino Barrett
(74) *Attorney, Agent, or Firm*—Dennis W. Beech

(57) ABSTRACT

The bolt lock with protective cover has a back enclosure containing a sliding bolt which combination is inserted into a cover enclosure. The cover enclosure with back enclosure is attached to a door, gate or other such structure for purposes of securing the closure. The sliding bolt is slidably engaged with an insertion end, a bolt end and an intermediate element to guide and retain the bolt for slidable engagement with a shackle and retention of a padlock. The slide bolt has orthogonal locking pins and a handle to move the slide bolt into a locked and unlocked position and to retain the bolt when the padlock is locked. A bolt lock end passes through a hole in the back enclosure bolt end and an exit hole in the cover enclosure bolt end to engage a structure such as door jamb.

11 Claims, 2 Drawing Sheets

BOLT LOCK WITH PROTECTIVE COVER

BACKGROUND OF THE INVENTION

1. Field of The Invention

This invention relates to lockable bolt apparatus used for securing doors, gates and other closures. The new device incorporates an enclosure to protect a sliding bolt and padlock for use in securing a door or other closures.

2. Description of Related Art

1. The sliding bolt with flanges to support the bolt and mechanism to secure the bolt in an extended locked position or retracted unlocked position using a padlock has been in use for many years. In addition there have been various attempts to protect the padlock and/or slide bolt from access by persons wishing to break or cut the lock to gain entry.

2. Examples of protective mechanisms are those such as disclosed in U.S. Pat. Nos. 3,953,062 and 4,655,487. The U.S. Pat. No. 4,655,487 uses the basic sliding bolt with padlock structure and incorporates a stationary safety cover across the front spaced from a back plate to enclose the sliding bolt and other elements of the lock. In the case of the U.S. Pat. No. 3,953,062 two bale support members are incorporated with a front plate member to overlie portions of the padlock bale to restrict access thereto in the locked position. Both of these latches are difficult to use as the padlock must be manipulated in and out of the cover elements. Also, the padlock must be kept accessible for relocking as it must be removed when unlocking the door. The designs do not provide protection for the slide when it is in the extended or locked position.

3. The present invention incorporates a rectangular box enclosure to protect the slide bolt and a padlock. The slide bolt mechanism is completely enclosed in a cover enclosure and the padlock shackle with most of the latching mechanism or bale are enclose in the cover enclosure. Once the padlock is installed with the sliding bolt the padlock remains engaged such that it cannot be removed either in the locked or unlocked position. This structure protects the bolt and lock from tampering and retains the padlock for ease of use in either the locked or unlocked position.

SUMMARY OF THE INVENTION

One object of the present invention is protection from tampering with the sliding bolt and padlock of a locking mechanism. Another object is retention of the padlock with the protective cover in the open or unlocked condition. A further object is securing of the sliding bolt in the extended or retracted position. An additional object is to minimize the exposure of the slide bolt in the extended or locked position.

In accordance with the description presented herein, other objectives of this invention will become apparent when the description and drawings are reviewed.

DESCRIPTION OF THE PREFERRED EMBODIMENT

1. The bolt lock with protective cover includes a back enclosure with slots and apertures to support a sliding bolt. A cover enclosure receives the back enclosure and sliding bolt thereby covering the locking mechanism. The bolt lock with protective cover is assembled by positioning a padlock such that the slide bolt may be inserted through the shackle as it is slidably engaged with the back enclosure. The cover enclosure is then placed over the back enclosure with the padlock latch mechanism or bale rear portion extending therethrough. The entire device is then bolted to the door, gate or other closure element in position to engage the supporting door jamb or other structure. The back enclosure and cover enclosure may be fabricated from a relatively rigid durable metal. This with the structure of the overlapping boxes creating a doubling of the side walls provides a relatively secure construction which when fabricated from flat metal stock and properly bent does not require welding of the enclosure corners.

Figure 1:
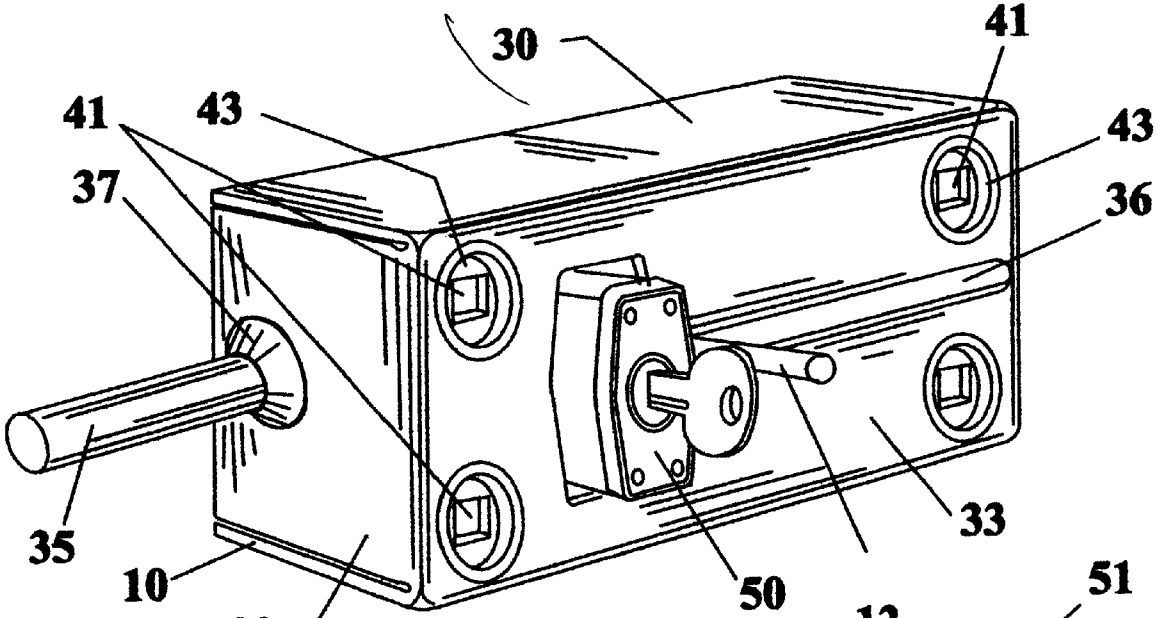
FIG. 1 illustrates a perspective view of the bolt lock and protective cover.
Figure 2:
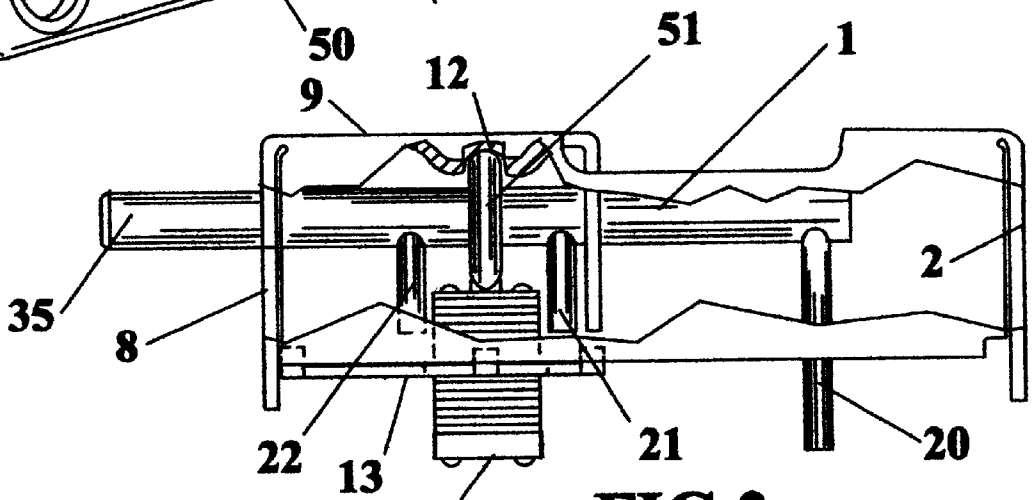
FIG. 2 illustrates a side cross-sectional view of the device.
Figure 3:
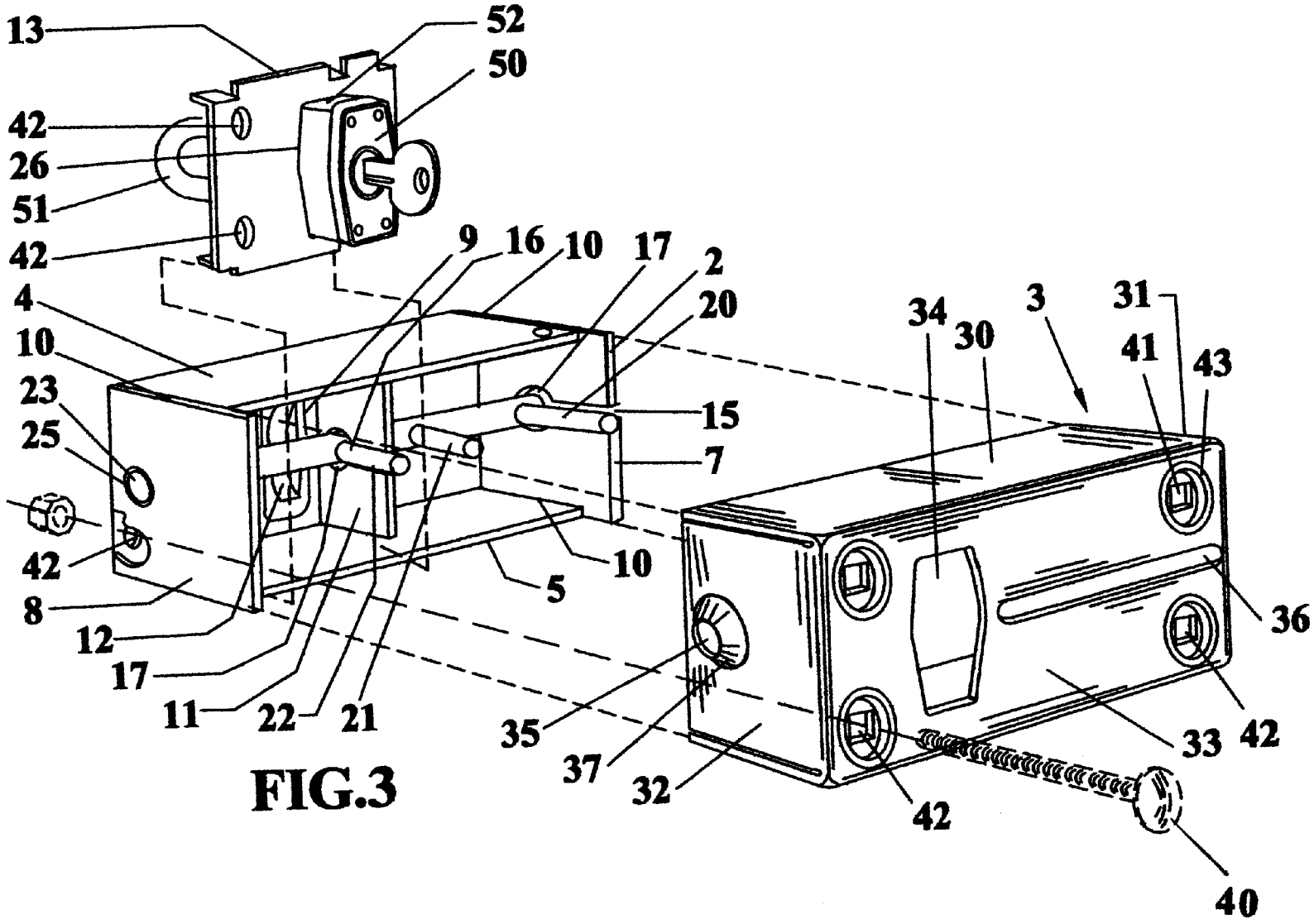
FIG. 3 illustrates an exploded view of the device.

2. Referring to FIGS. 1 through 3, a slide bolt (1) is slidably engaged in a back enclosure (2) inserted into and received by a cover enclosure (3). The back enclosure (2) may be initially formed from flat stock metal material. The two side plates (4,5) and the insertion end (7) and bolt end (8) are formed by bending the material to be orthogonal with the back plate (9). Welding of the corners (10) may be performed, but is not required for rigid material.

3. An intermediate element (11) is formed in the back enclosure (2) in parallel with the insertion end (7) and bolt end (8). Also, a padlock shackle recess (12) may be formed on the interior surface of the back plate (2) for receiving the end of shackle or bale (51) of the padlock (50).

4. The insertion end (7) and intermediate element (11) have slots (15,16) with enlarged circular slot ends (17) oriented to allow the slide bolt (1) with protrusions (20,21, 22) to be slidably inserted into the back cover (2). In addition the bolt end (8) has an aperture (25) through which the bolt (1) may protrude. For assembly of this portion of the device the bolt (1) is slidably inserted through slot (15) in the insertion end (7) and then through slot (16) to be located internal to the back enclosure (2). To engage the bolt (1) in a locked position as, for example, insertion in an aperture of a door jamb, the bolt lock end (23) is slid outwardly through aperture (25) by the user moving the bolt (1) by means of protrusion (20) or the handle.

5. A padlock support plate (13) is assembled on side plates (4,5) to retain the padlock (50) generally orthogonal to the bolt (1). The shackle (51) of the padlock (50) is inserted into the shackle recess (12). The support plate (13) is then mounted on the side plates (4,5) with the padlock latch mechanism (52) protruding through a latch aperture (26). With the padlock (50) in the unlocked position the bolt (1) is inserted through the shackle (51) as part of the assembly as described in paragraph 4.

6. In use, as the bolt (1) is moved relative to the back enclosure (2) the protrusions (21,22) are of a length to allow the bolt (1) to slide through the shackle (51). The padlock (50) when closed prevents movement of the bolt (1) through the shackle (51) because there is not sufficient clearance for protrusions (21,22) to pass therethrough. The protrusions (21,22) are positioned on the bolt (1) shaft such that closure of the padlock (50) retains the bolt (1) in an open and in a locked position. Protrusions (21,22) may also be positioned to provide three positions in which the slide bolt (1) may be retained, for example, in an open, a partially extended and a fully extended position.

7. The back enclosure (2) is inserted into a cover enclosure (3) with back plate (9) exposed. The cover enclosure (3) has sides (30), a cover end (31) and bolt aperture end (32), and a cover plate (33). The cover plate (33) has cover aperture (34) through which the latch mechanism (52) of the padlock (50) protrudes when the device is assembled. There is an exit aperture (35) in the bolt aperture end (32) through which bolt lock end (23) passes when the bolt (1) is moved to engage a door jamb or other structural element for purposes of securing a door. The bolt (1) is moved by a user applying force on the handle (20) which protrudes through handle slot (36) in cover plate (33).

8. The device is normally attached to a door or other device to be secured by use of fasteners such as bolts (40). The bolts (40) project through bolt apertures (42) and the door to which mounted and are then secured by nuts (41). Use of a recess (43) in the cover plate (33) and carriage type bolts (40) inhibits access to the heads of the bolts (40) to gain access to the bolt lock and protective cover.

9. In use the bolt lock with protective cover should be attached to the door or other closure element such that the exit aperture (35) is as close as possible to the structure into which the bolt (1) is to be inserted when locked. This inhibits access to the bolt lock end (23) where for example bolt cutters might be used to defeat the lock. The bolt aperture end (32) is also illustrated with a raised structure (37) to further protect the bolt lock end (23). In either the locked or unlocked position the padlock (50) is retained in the device as the bolt (1) is slidably engaged with the shackle. This provides ease of use when locking and unlocking the bolt lock with protective cover.

8. While the invention has been particularly shown and described with respect to the illustrated and preferred embodiments thereof, it will be understood by those skilled in the art that the foregoing and other changes in form and details may be made therein without departing from the spirit and scope of the invention.

I claim:

1. A device for mounting on a door, gate and closure for securing thereof with a padlock comprising:

a back enclosure having a back plate, a pair of side plates, an insertion end having a slot therein, and a bolt end having an aperture therein;

an intermediate element having a slot therein is attached to the back plate approximately parallel to the insertion end and the bolt end;

a slide bolt slidably engaged with the insertion end slot, the intermediate element slot and the bolt end aperture wherein the slide bolt having a pair of lock protrusions and a handle protrusion oriented to pass through the slots such that a bolt lock end may extend and be retracted through the bolt end aperture;

a padlock support plate mounted on the side plates located for supportable engagement of a padlock inserted through a latch aperture formed therein and slidably engaged with the slide bolt;

the back enclosure inserted into a cover enclosure having two sides, a cover end, a bolt aperture end having an exit aperture formed therein, and a cover plate having a cover aperture and a handle slot formed therein;

and a means for attachment of the cover enclosure with inserted back enclosure to a structure.

2. The device as in claim 1 wherein the cover aperture is sized to accommodate a variety of padlock latch mechanisms and the latch aperture is sized to closely envelop the padlock latch mechanism.

3. The device as in claim 1 wherein the back plate having a shackle recess formed on an interior surface thereof wherein the shackle recess is located to receive a padlock shackle when the shackle is engaged with the slide bolt.

4. The device as in claim 1 wherein the means for attachment is a plurality of bolts and nuts and the back plate and cover plate having bolt apertures therein.

5. The device as in claim 1 wherein the bolt aperture being formed in a recess portion of the cover plate.

6. The device as in claim 1 wherein the exit aperture having a raised structure formed thereround.

7. The device as in claim 1 wherein the lock protrusions and the handle protrusion are in the form of pins attached to and extending orthogonally from the slide bolt.

8. The device as in claim 1 wherein the back enclosure is formed from a piece of flat metal stock and the side plates, insertion end, bolt end and intermediate element are formed by bending the elements orthogonal to the back plate.

9. The device as in claim 1 wherein a plurality of corners of the back enclosure are attached along the edges thereof.

10. The device as in claim 9 wherein the attachment is by means of a weld joint.

11. The device as in claim 1 wherein the insertion slot and the intermediate slot have an enlarged, circular slot end formed therein.

* * * * *